US012654065B2

(12) United States Patent
Kachlany

(10) Patent No.: US 12,654,065 B2
(45) Date of Patent: Jun. 16, 2026

(54) SUPINATION EXERCISE DEVICE AND METHOD OF USE

(71) Applicant: MY FLEXX FIT, LLC, Greenville, SC (US)

(72) Inventor: Scott Kachlany, Bridgewater, NJ (US)

(73) Assignee: My Flexx Fit, LLC, Greenville, SC (US)

( * ) Notice: Subject to any disclaimer, the term of this patent is extended or adjusted under 35 U.S.C. 154(b) by 51 days.

(21) Appl. No.: 18/525,154

(22) Filed: Nov. 30, 2023

(65) Prior Publication Data

US 2024/0189662 A1 Jun. 13, 2024

Related U.S. Application Data

(60) Provisional application No. 63/459,768, filed on Apr. 17, 2023, provisional application No. 63/430,695, filed on Dec. 7, 2022.

(51) Int. Cl.

| | |
|---|---|
| ***A63B 23/14*** | (2006.01) |
| ***A63B 21/00*** | (2006.01) |
| ***A63B 21/068*** | (2006.01) |
| ***A63B 23/035*** | (2006.01) |

(52) U.S. Cl.

CPC ..... *A63B 23/14* (2013.01); *A63B 21/068* (2013.01); *A63B 21/151* (2013.01); *A63B 21/4035* (2015.10); *A63B 21/4049* (2015.10); *A63B 23/03525* (2013.01)

(58) Field of Classification Search

CPC ..... A63B 23/14; A63B 21/068; A63B 21/151; A63B 21/4035; A63B 21/4049; A63B 23/03525

See application file for complete search history.

(56) References Cited

U.S. PATENT DOCUMENTS

| | | | | |
|---|---|---|---|---|
| 10,058,725 | B2 * | 8/2018 | LaCaze | A63B 21/023 |
| 2004/0029688 | A1 * | 2/2004 | Webber | A63B 21/155 482/142 |
| 2009/0111661 | A1 * | 4/2009 | Hauser | A63B 23/1209 482/40 |
| 2011/0173778 | A1 * | 7/2011 | Wales | B25G 3/20 16/426 |
| 2013/0303349 | A1 * | 11/2013 | Kristiansen | A63B 21/40 482/139 |
| 2017/0157457 | A1 * | 6/2017 | Kurabieski | A63B 21/4035 |
| 2019/0314670 | A1 * | 10/2019 | Kim | A63B 23/03525 |
| 2023/0302323 | A1 * | 9/2023 | Sasano | A63B 21/4035 |

* cited by examiner

*Primary Examiner* — Evan P Dzierzynski
(74) *Attorney, Agent, or Firm* — Wood, Phillips, Katz, Clark & Mortimer

(57) ABSTRACT

An exercise device (40) includes an attachment body (44) for attaching the device (40) to a rigid bar (48) or an attachment means (58) on one end of a weighted cable. The device (40) further includes a gripping body (52) for being gripped by a user and which is connected to the attachment body (44) by a rotational joint (56). The attachment body (44) and the gripping body (52) are configured to permit a user to supinate the user's wrist during a pulling exercise.

18 Claims, 5 Drawing Sheets

SUPINATION EXERCISE DEVICE AND METHOD OF USE

PRIORITY

The present application claims priority from U.S. Provisional Patent Application No. 63/430,695, filed on Dec. 7, 2022, and U.S. Provisional Patent Application No. 63/459,768, filed on Apr. 17, 2023, the entire contents of which are incorporated herein by reference.

TECHNICAL FIELD

The present invention relates generally to a handheld gripping apparatus or device that is used during a workout and allows a user to supinate (i.e., twist) his or her wrist while carrying out a pulling motion.

BACKGROUND OF THE INVENTION

Typically, a pull up exercise is performed with a user's hand gripped in a stationary or fixed position while hanging from a rigid bar.

There further remains a need for providing an improved exercise device that allows for a more dynamic motion during a pulling type exercise (e.g., pull ups, lat pull downs, lat rows, deadlifts, barbell pulls, and bicep curls, etc.) and that is amenable to mass-production at a reasonable cost.

BRIEF SUMMARY OF THE INVENTION

In accordance with the present invention, an exercise device is provided that includes an attachment body for attaching the device to a rigid bar or a hook or carabiner or other connection means attached to a cable pulley. The exercise device includes a gripping body for being gripped by a user and which is connected to the attachment body by a rotational joint. The attachment body and the gripping body are configured to permit a user to supinate the user's wrist during a pulling exercise.

According to one broad form of the present invention, the exercise device includes an attachment body for attaching the device to a rigid bar. The device includes a gripping body for being gripped by a user and connected to the attachment body by a rotational joint. The attachment body and the gripping body are configured to permit a user to supinate the user's wrist during a pulling exercise.

In one preferred form of the present invention, the device includes a second attachment body for attaching to the rigid bar and a second gripping body connected to the second attachment body by a second rotational joint wherein the second attachment body and the second gripping body are configured to permit a user to supinate the user's other wrist during a pulling exercise.

In another form of the present invention, the attachment body includes a hook that has the form of an elongate sheath.

According to another form of the present invention, the attachment body is configured to grip a rigid bar that is straight, W-shaped, curved, or V-shaped.

In yet another form of the present invention, the gripping body has the form of a U-shaped upper portion suspended from the rotational joint and a straight lower portion retained within the U-shaped upper portion.

In one preferred form of the present invention, the rotational joint is an assembly of a threaded connector and a plurality of spacers.

In still another preferred form of the present invention, the attachment body defines a vertical wall portion terminating in a curved hook portion and an angled base portion that extends laterally away from and then back toward the vertical wall portion.

According to one preferred form of the present invention, the base portion includes an aperture exposing the rotational joint.

In another preferred form of the present invention, the angled base portion is connected to the vertical wall portion by a pair of welds located on opposite sides of the rotational axis defined by the rotational joint.

In still another form of the present invention, the vertical wall portion, curved hook portion, and an angled base portion are a unitary, metal construction.

Preferably, the wall portion, the curved hook portion, and the angled base portion have the same width, in a direction perpendicular to a rotational axis of the rotational joint.

In another preferred form of the present invention, the angled base portion connects about in the middle of the vertical wall portion.

According to another form of the present invention, the attachment body further includes a central flange having at least one hole for receiving an attachment means on one end of a weighted cable pulley.

According to still another form of the present invention, the attachment body further includes a friction means for contacting a rigid bar to minimize relative motion between the attachment body and the rigid bar during use of the device. Preferably, the friction means has the form of a pair of spaced-apart strips extending from a vertical wall portion of the attachment body and terminating in a curved hook portion of the attachment body.

In another preferred form of the present invention, the attachment body includes a curved hook portion in the form of a sheath that extends more than half the width of the gripping body in a direction perpendicular to a rotational axis of the rotational joint.

In still another form of the present invention, the gripping body includes a rigid, U-shaped upper portion and a hand grip retained on a rod extending between ends of the U-shaped upper portion.

According to one broad form of the present invention, a method of using an exercise device is disclosed. The method includes the step of obtaining a pair of exercise devices, wherein each one of the exercise devices has: an attachment body for attaching the device to a rigid bar; a gripping body for being gripped by a user and connected to the attachment body by a rotational joint; and the attachment body and the gripping body are configured to permit a user to supinate the user's wrist during a pulling exercise. The method includes the step of attaching the attachment body of each one of the pair of devices to a rigid bar. The method includes the step of gripping the gripping body of each one of the pair of devices. The method includes the further step of rotating the gripping body relative to the attachment body about the rotational joint of each one of the pair of devices to supinate the user's wrist during a pulling exercise.

In one preferred form of the present invention, the method includes the further step of attaching the attachment body of each one of the pair of devices to an attachment means on one end of a cable pulley.

Other features and advantages will become readily apparent from the accompanying drawings and the appended claims.

BRIEF DESCRIPTION OF THE DRAWINGS

FIG. 5 shows the apparatus connected to a carabiner for a weighted cable or pulley of a machine for performing a pulling-type exercise;

FIG. 6 shows the apparatus connected to a bar for performing pull-up type exercise;

FIG. 11 shows only the attachment body portion of the apparatus.

DETAILED DESCRIPTION OF THE PREFERRED EMBODIMENTS

Figure 2:
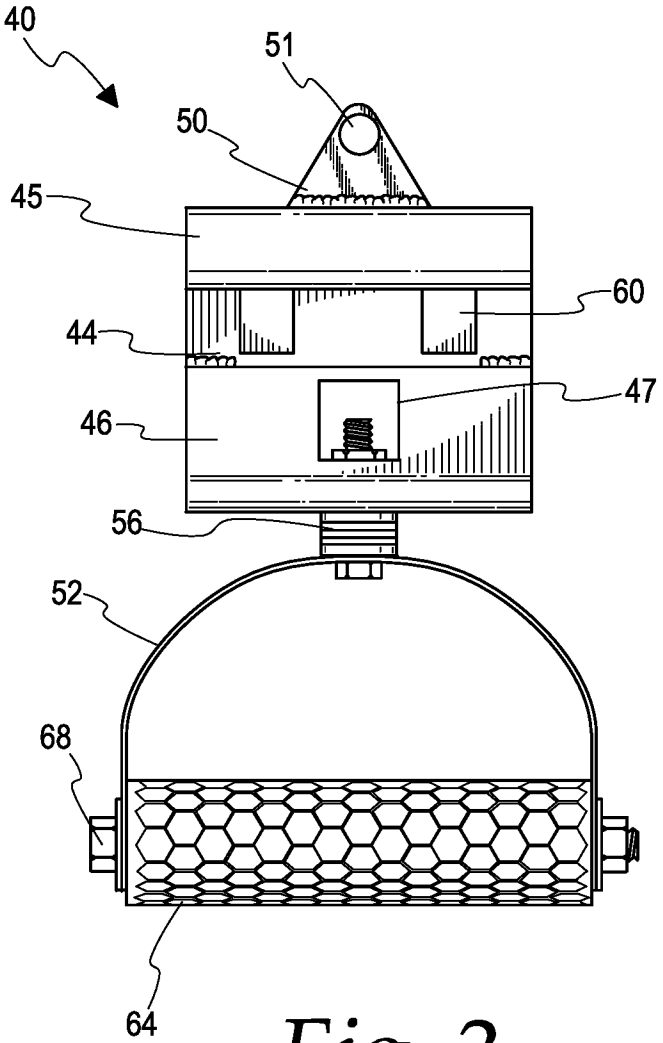
FIG. 2 is a front elevation view of another apparatus of the present invention for use with the apparatus of FIG. 1 as a pair to perform exercises.

While the present invention is susceptible of embodiment in various forms, there is shown in the drawings and will hereinafter be described the presently preferred embodiments, with the understanding that the present disclosure should be considered as an exemplification of the invention and is not intended to limit the invention to the specific embodiments illustrated.

In accordance with the illustrated preferred embodiments of the invention, and components thereof, as illustrated in the attached FIGS. 1-10, the invention has the form of an exercise apparatus or device 40. The device 40 is used during a workout, and allows a user to supinate (i.e., twist) his or her wrist while carrying out a pulling motion. This dynamic movement results in a full range of motion of the wrist, which works different muscle groups compared to static or fixed hand placement. The device 40 can be made from strong metal (e.g., iron, steel, etc.) and can include a comfortable, soft grip (e.g., rubber, foam, elastomer, etc.). Examples of exercises where this device 40 could be used include pull ups, lat pull downs, lat rows, deadlifts, barbell pulls, and bicep curls, etc.

Figure 1:
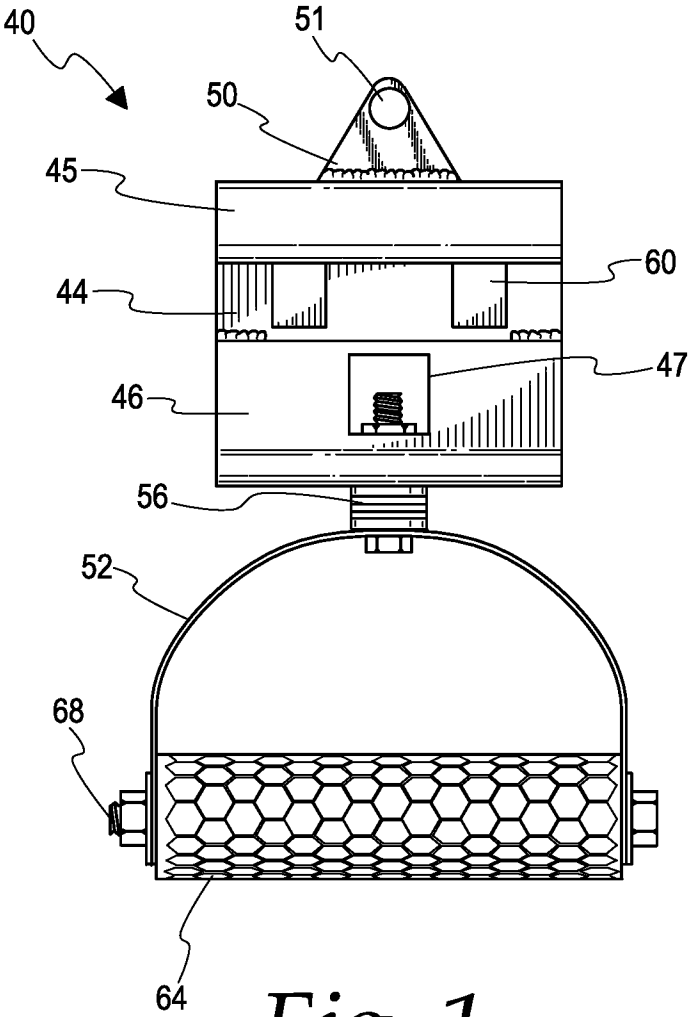
FIG. 1 is a front elevation view of an apparatus of the present invention.
Figure 4:
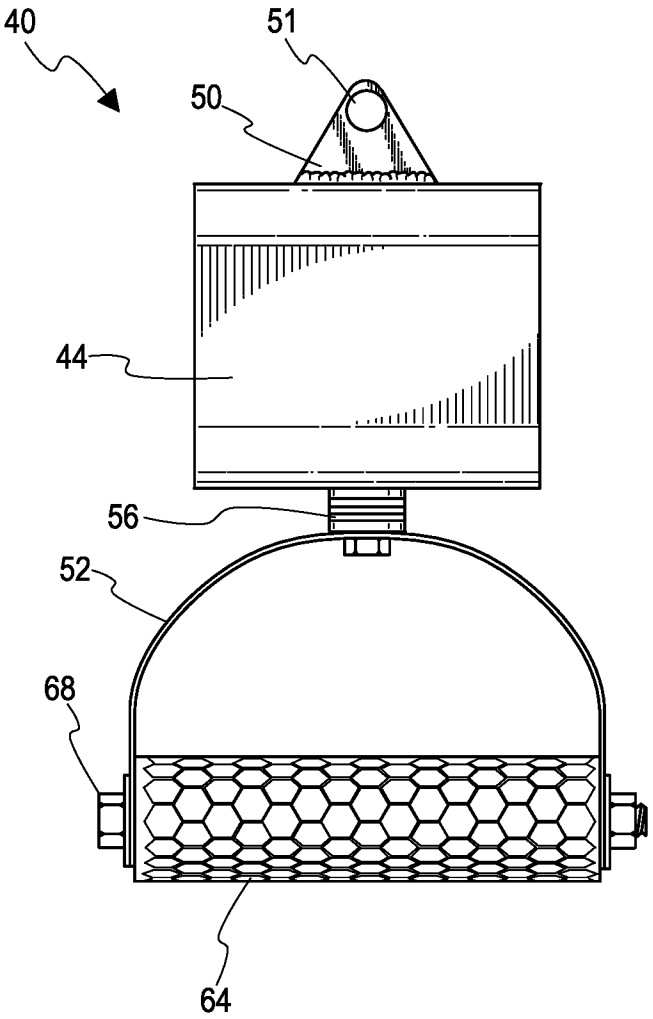
FIG. 4 is a rear elevation view of the apparatus of FIG. 2.
Figure 3:
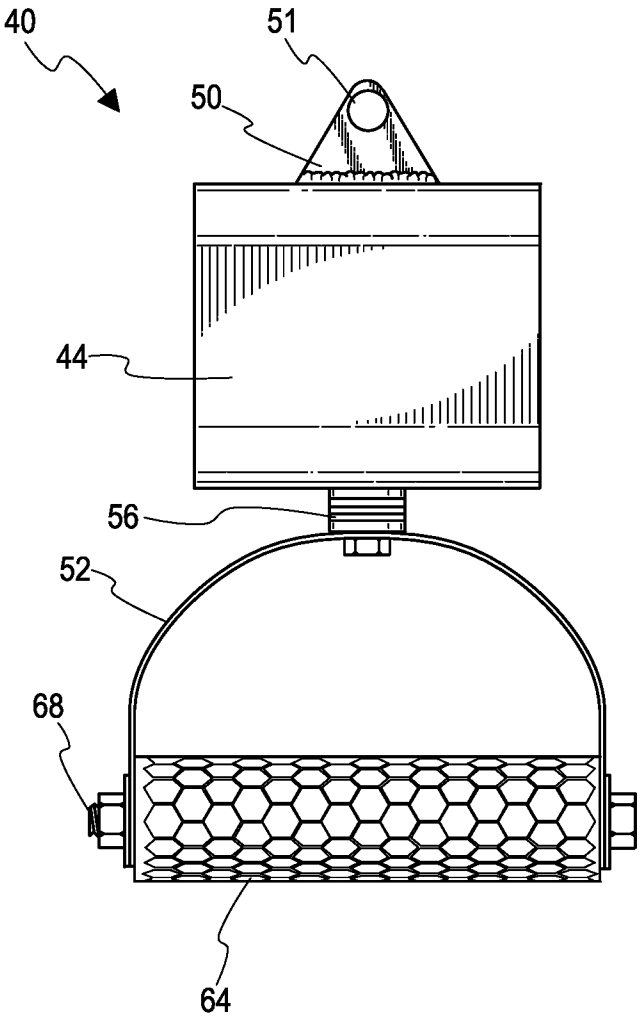
FIG. 3 is a rear elevation view of the apparatus of FIG. 1.

With reference now to FIG. 1, the device 40 includes the primary structures of an attachment body 44 for attaching to a rigid bar 48 or other structure (visible in FIG. 6), a gripping body 52, and a pivot or rotational joint 56 located between the attachment body 44 and the gripping body 52. The attachment body 44 preferably has the form of an elongate sheath or hook that is sufficiently strong to support the weight of the user and that defines an enclosed space to capture the rigid bar 48. In some forms, not illustrated, the attachment body 44 could be angled to attach to a non-straight rigid bar (e.g., a W-shaped, curved, or V-shaped bar). In a non-preferred form, the attachment body 44 could have the form of a plurality of discrete and spaced apart hooks instead of a sheath. Preferably, the sheath-like attachment body 44 has a length at least half that of the gripping body 52 in the axial direction of the bar 48.

The gripping body 52 is preferably rigid such that the user can effect relative rotation between the gripping body 52 and the attachment body 44 via the rotational joint 56. Directions referenced in the specification are generally oriented relative to the rotational axis of the rotational joint 56, which extends from the top to the bottom of the page in FIGS. 1-4 and 7-8, through the center of the rotational joint 56. The width of the device 40 is generally in the orthogonal direction that extends perpendicular to the rotational axis (i.e., directions left to right in FIGS. 1-4, and 9-10). The depth of the device 40 orthogonal to both the rotational axis and the width, and extends upwards and downwards in FIGS. 9-10.

Figure 5:
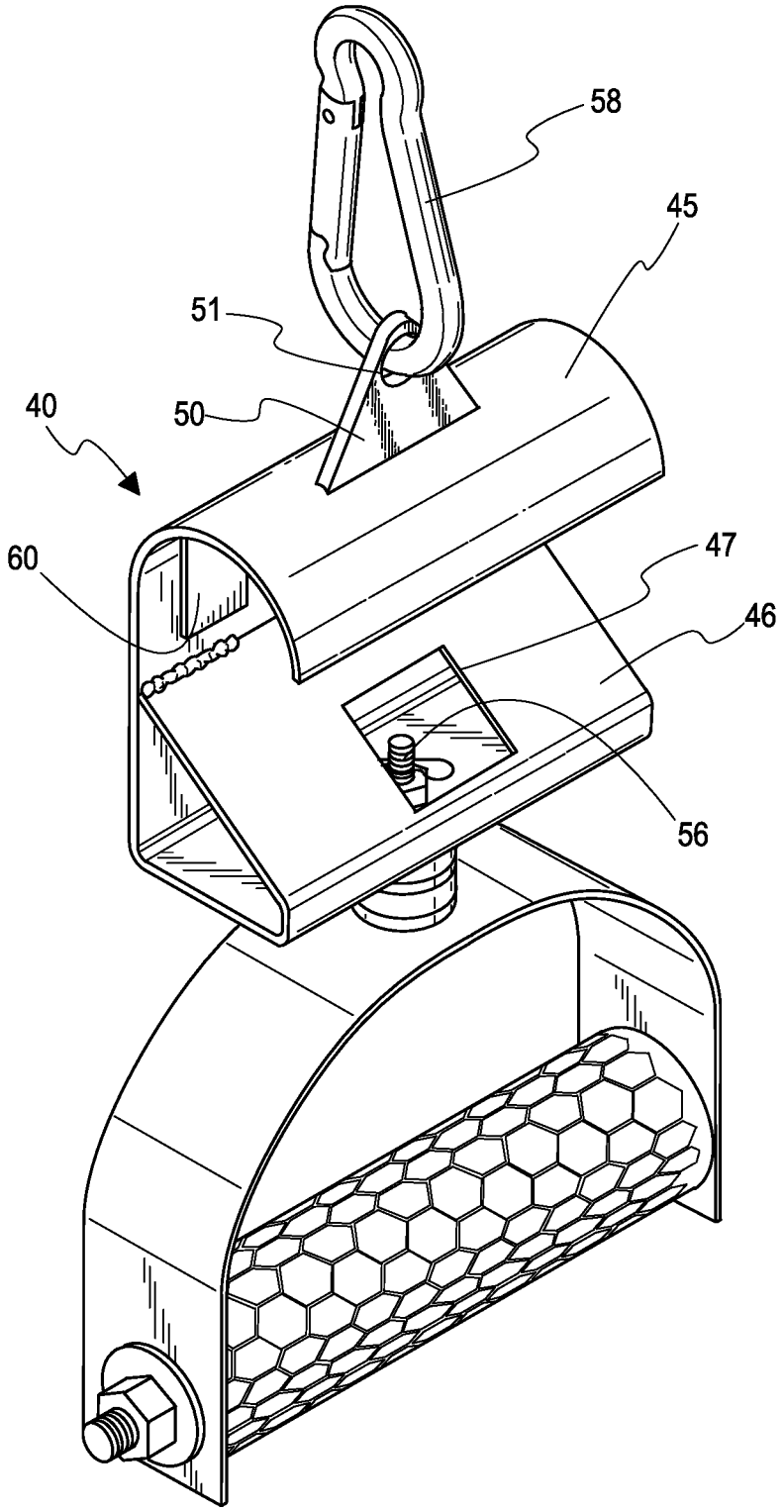
FIG. 5 is an isometric view, from the top front and left side of the apparatus of FIG. 1.
Figure 6:
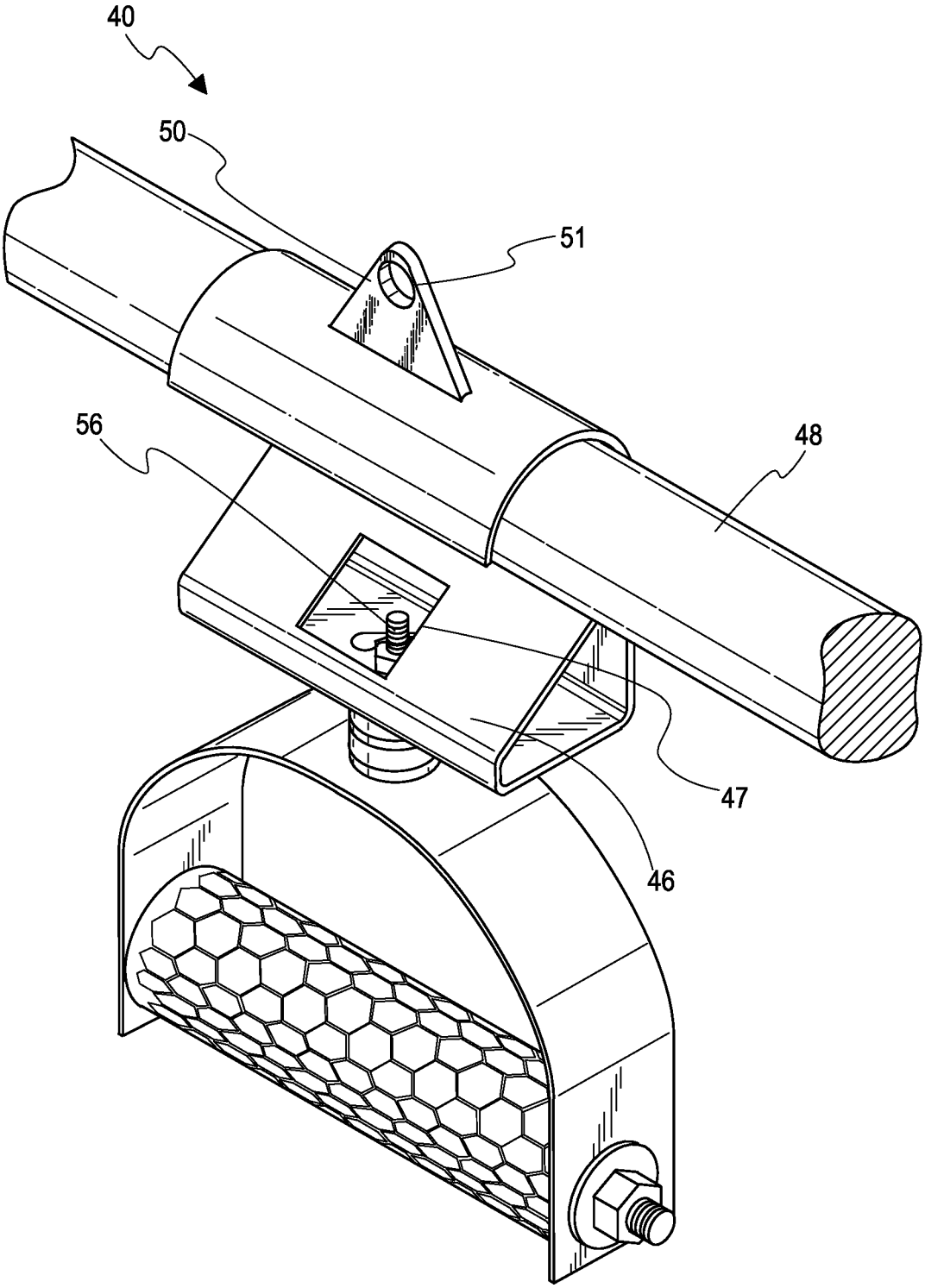
FIG. 6 is an isometric view, from the top front and right side of the apparatus of FIG. 1.
Figure 9:
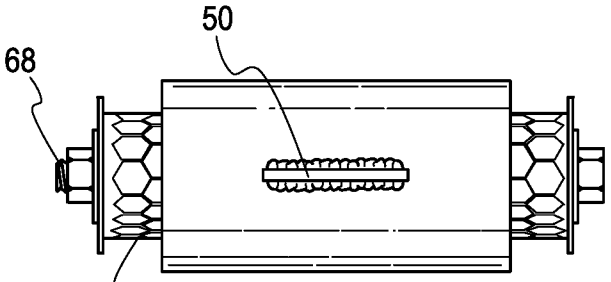
FIG. 9 is a top plan view of the apparatus of FIG. 1.
Figure 10:
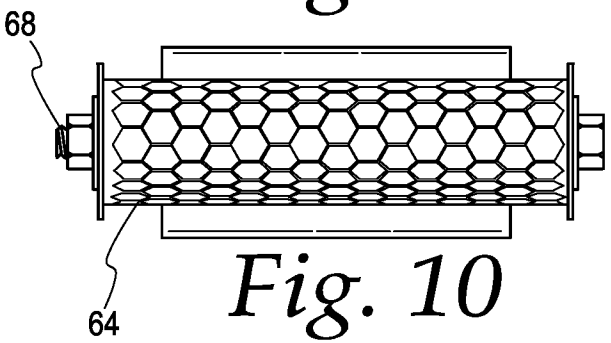
FIG. 10 is a bottom plan view of the apparatus of FIG. 1.
Figure 11:
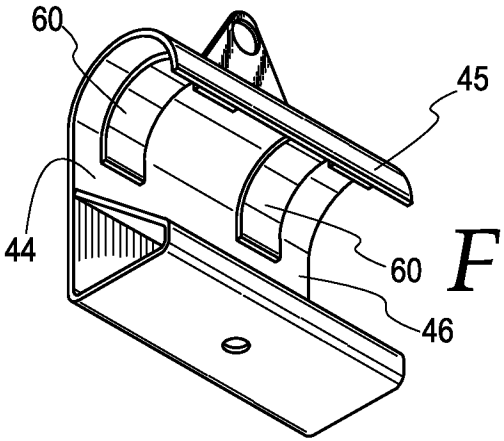
FIG. 11 is an isometric view, from the bottom front and left side of the apparatus of FIG. 1.
Figure 8:
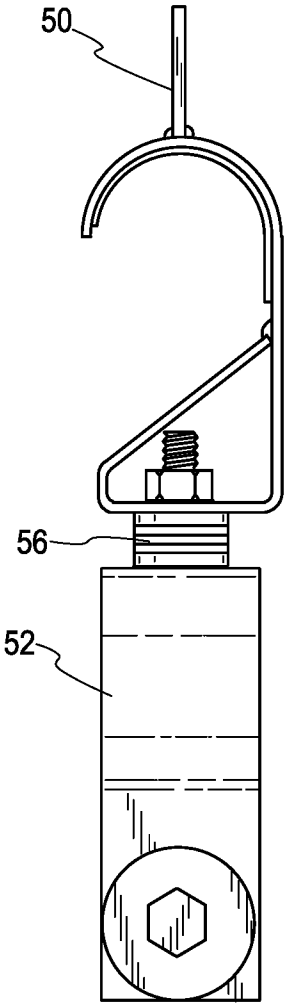
FIG. 8 is a right side elevational view of the apparatus of FIG. 1.
Figure 7:
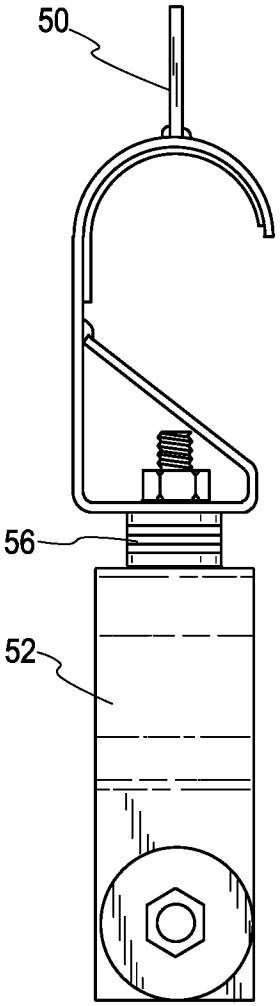
FIG. 7 is a left side elevational view of the apparatus of FIG. 1.

With reference to FIG. 5, the presently preferred form of the attachment body 44 has a generally vertical wall portion terminating at a top end in a downwardly-curved hook portion 45 for retaining the rigid bar 48, and the vertical wall further terminating at a bottom end in an angled base portion 46 that extends laterally away from, and then back toward, the vertical wall portion. The angled base portion 46 advantageously provides additional rigidity and stability to the device 40 and has an aperture or window 47 formed therein to provide access to the rotational joint 56 that connects the attachment body 44 to the gripping body 52. The angled base portion 46 is preferably attached to the vertical wall by one or more welds or other attachment means (visible in FIG. 1). The vertical wall portion extends parallel to the rotational axis of the joint 56.

The curved hook portion 45 is further advantageously provided with a vertically extending, centered flange 50 having at least one hole 51 for receiving a hook, carabiner, or other attachment means 58 on one end of a cable pulley on a weight machine or other resistance exercise apparatus (as shown in FIG. 5).

In addition, one or more high-friction means (relatively higher friction than the rigid metal material of the body 44) or polymer or rubber grips 60 are optionally located on the attachment body 44 vertical wall and/or the curved hook portion 45 to permit the device to remain more securely on a bar 48 and prevent sliding during use of the device 40.

In the preferred form of the present device 40, the gripping body 52 has the form of a rigid metal, U-shaped member. A soft rubber or a polymer hand grip 64 is retained on a rod 68 extending between the ends of the U-shaped gripping body 52. The hand grip 64 may be rotatable relative to the gripping body 52 or may be rotationally fixed relative to the gripping body 52.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

The invention claimed is:

1. An exercise device comprising:

an attachment body for attaching said device to a rigid bar;

a gripping body for being gripped by a user and connected to said attachment body by a rotational joint; wherein said attachment body and said gripping body are configured to permit a user to supinate the user's wrist during a pulling exercise, wherein said attachment body includes a curved hook portion in the form of a sheath that extends more than half the width of said gripping body in a direction perpendicular to a rotational axis of said rotational joint.

2. The exercise device according to claim 1 further comprising a second attachment body for attaching to said rigid bar;

a second gripping body connected to said second attachment body by a second rotational joint wherein said second attachment body and said second gripping body are configured to permit a user to supinate the user's other wrist during a pulling exercise.

3. The exercise device according to claim 1 wherein said attachment body includes a hook that has the form of an elongate sheath.

4. The exercise device according to claim 1 wherein said attachment body is configured to grip a rigid bar that is straight, W-shaped, curved, or V-shaped.

5. The exercise device according to claim 1 wherein said gripping body has the form of a U-shaped upper portion suspended from said rotational joint and a straight lower portion retained within said U-shaped upper portion.

6. The exercise device according to claim 1 wherein said rotational joint is an assembly of a threaded connector and a plurality of spacers.

7. The exercise device according to claim 1 wherein said attachment body further comprises a central flange having at least one hole for receiving an attachment means on one end of a weighted cable pulley.

8. The exercise device according to claim 1 wherein said attachment body further comprises a friction means for contacting a rigid bar to minimize relative motion between said attachment body and said rigid bar during use of said device.

9. The exercise device according to claim 1 further wherein said gripping body includes a rigid, U-shaped upper portion and a hand grip retained on a rod extending between ends of said U-shaped upper portion.

10. An exercise device comprising:

an attachment body for attaching said device to a rigid bar;

a gripping body for being gripped by a user and connected to said attachment body by a rotational joint; wherein said attachment body and said gripping body are configured to permit a user to supinate the user's wrist during a pulling exercise, wherein said attachment body defines a vertical wall portion terminating in a curved hook portion and an angled base portion that extends laterally away from and then back toward said vertical wall portion.

11. The exercise device according to claim 10 wherein said angled base portion comprises an aperture exposing said rotational joint.

12. The exercise device according to claim 10 wherein said angled base portion is connected to said vertical wall portion by a pair of welds located on opposite sides of said rotational joint.

13. The exercise device according to claim 10 wherein said vertical wall portion, said curved hook portion, and said angled base portion are a unitary metal construction.

14. The exercise device according to claim 10 wherein said vertical wall portion, said curved hook portion, and said angled base portion have the same width in a direction perpendicular to a rotational axis of said rotational joint.

15. The exercise device according to claim 10 wherein said angled base portion connects in the middle of said vertical wall portion.

16. An exercise device comprising:

an attachment body for attaching said device to a rigid bar;

a gripping body for being gripped by a user and connected to said attachment body by a rotational joint; wherein said attachment body and said gripping body are configured to permit a user to supinate the user's wrist during a pulling exercise, wherein said attachment body further comprises a friction means for contacting a rigid bar to minimize relative motion between said attachment body and said rigid bar during use of said device, wherein said friction means have the form of a pair of spaced-apart strips extending from a vertical wall portion of said attachment body and terminating in a curved hook portion of said attachment body.

17. A method of using an exercise device, said method comprising the steps of:

obtaining a pair of exercise devices, each one of said exercise devices having an attachment body for attaching said device to a rigid bar, a gripping body for being gripped by a user and connected to said attachment body by a rotational joint, and said attachment body and said gripping body are configured to permit a user to supinate the user's wrist during a pulling exercise, wherein said attachment body includes a curved hook portion in the form of a sheath that extends more than half the width of said gripping body in a direction perpendicular to a rotational axis of said rotational joint;

attaching said attachment body of each one of said pair of devices to a rigid bar;

gripping said gripping body of each one of said pair of devices; and rotating said gripping body relative to said attachment body about said rotational joint of each one of said pair of devices to supinate the user's wrist during a pulling exercise.

18. The method of using an exercise device according to claim 17 further comprising the step of attaching said attachment body of each one of said pair of devices to an attachment means on one end of a cable pulley.

* * * * *